United States Patent [19]

Cavallaro et al.

[11] Patent Number: 4,872,811

[45] Date of Patent: Oct. 10, 1989

[54] INBOARD SERVO FOR MARINE CONTROLLABLE PITCH PROPELLERS

[75] Inventors: Joseph L. Cavallaro, Canton; Patrick J. Kelly, Jr., Shrewsbury, both of Mass.

[73] Assignee: Bird-Johnson Company, Walpole, Mass.

[21] Appl. No.: 80,785

[22] Filed: Aug. 3, 1987

[51] Int. Cl.[4] ..... B63H 3/08

[52] U.S. Cl. ..... 416/162; 416/46; 416/49; 416/154

[58] Field of Search ..... 416/49, 153, 154, 157 R, 416/162, 167, 163–164, 156, 147, 159, 166, 46, 48

[56] References Cited

U.S. PATENT DOCUMENTS

| | | | |
|---|---|---|---|
| 2,032,254 | 2/1936 | Caldwell | 416/46 |
| 2,523,053 | 9/1950 | Obrist | 416/157 R X |
| 2,807,327 | 9/1957 | Scott | 416/154 |
| 2,812,026 | 11/1957 | Branddon | 416/49 X |
| 3,027,949 | 4/1962 | Biermann | 416/49 |
| 3,261,405 | 7/1966 | Andrews | 416/48 X |
| 3,575,529 | 4/1971 | Bierman | 416/46 X |
| 4,428,716 | 1/1984 | Maloof | 416/154 X |
| 4,648,798 | 3/1987 | Voisard | 416/154 X |
| 4,650,402 | 3/1987 | Jones et al. | 416/49 X |

FOREIGN PATENT DOCUMENTS

| | | | |
|---|---|---|---|
| 985885 | 3/1951 | France | 416/157 R |
| 1260746 | 4/1961 | France | 416/49 |
| 1350013 | 12/1963 | France | 416/49 |
| 124586 | 4/1949 | Sweden | 416/49 |
| 588795 | 6/1947 | United Kingdom | 416/157 R |
| 674657 | 6/1952 | United Kingdom | 416/157 C |

*Primary Examiner*—Everette A. Powell, Jr.
*Attorney, Agent, or Firm*—Brumbaugh, Graves, Donohue & Raymond

[57] ABSTRACT

An inboard servo for a controllable pitch propeller of the force rod type comprises a feedback device having at least two feedback rods connected to the piston and extending through the cylinder end wall and an output ring connected to the rods. An emergency lock-up includes at least two threaded locking rods fastened to the cylinder and passing freely through holes in the feedback ring, each of which receives one or more nuts that can be threaded along the rod for engagement with the feedback ring to lock the piston in a desired position.

4 Claims, 1 Drawing Sheet

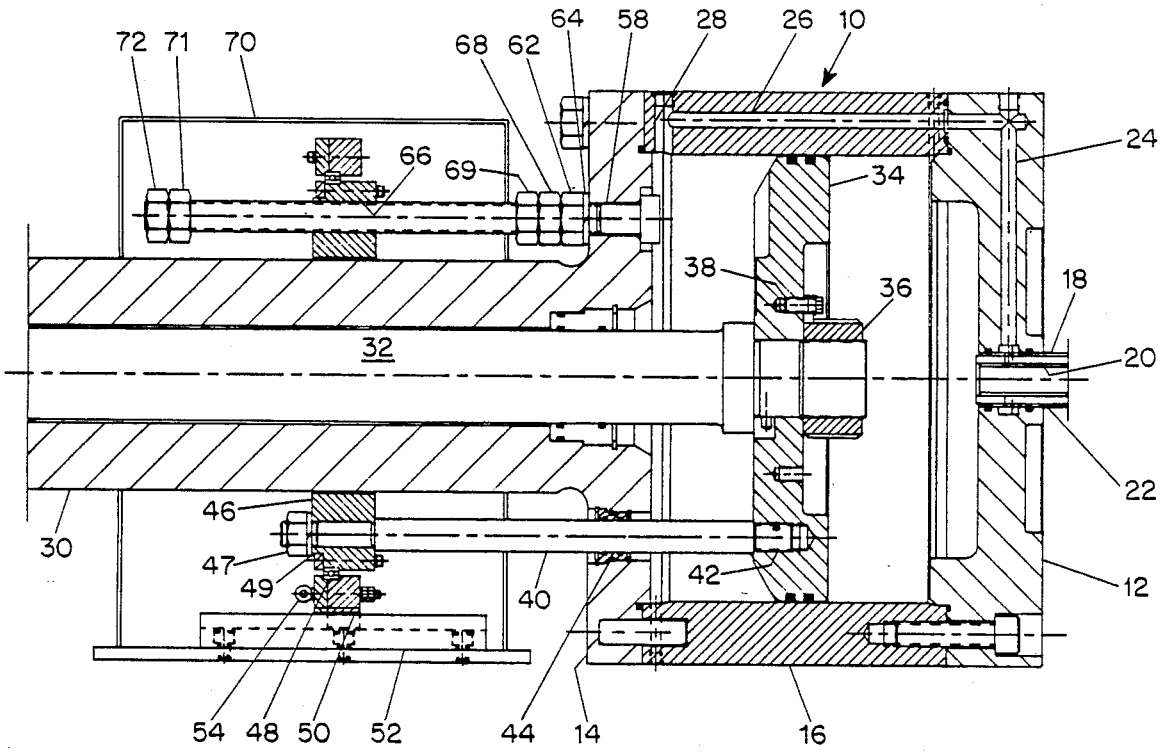
72
71
70
68
62
64
58
28
26
10
24
66
69
34
38
36
18
32
20
22
46
30
47
49
40
42
12
54
48
50
52
44
14
16

INBOARD SERVO FOR MARINE CONTROLLABLE PITCH PROPELLERS

BACKGROUND OF THE INVENTION

A well-known type of marine controllable pitch propeller comprises a pitch-adjusting mechanism in the propeller hub coupled to an inboard hydraulic cylinder by a force rod that extends through the propeller shaft. Usually, the control system for the propeller includes a feedback device that monitors the pitch of the propeller blades, and the inclusion of the feedback device accounts for the conventional use of the term "servo" to refer to the inboard hydraulic cylinder that actuates the pitch-controlling mechanism of the propeller. In a typical inboard servo installation the servo is interposed in the propeller shaft aft of the gear box, although in at least one commercially available system the servo is built into the output gear of the gear box. In either case the servo rotates with the shaft. To provide feedback to the control system, it is conventional to detect the longitudinal position of the force rod, which is indicative of the setting of the pitch-setting mechanism and, therefore, the pitch of the propeller blades. Because the propeller shaft and the force rod are rotating and the force rod moves axially within the rotating shaft, the feedback device commonly includes a coupling between the rotating force rod and a non-rotating feedback output element consisting of a special tubular coupling in the shaft having longitudinal slots of a length at least equal to the working stroke of the force rod, arms projecting from the force rod out through the slots, a rotating ring coupled to the arms and a follower riding in an external track on the ring.

Marine controllable pitch propeller systems also usually make some provision for so-called "emergency lock-up" of the propeller—fixing a predetermined ahead pitch of the blades by a mechanical device—in case of some malfunction in the servo or the control system. One known arrangement makes use of the same output device described above and takes the form of blocks that are inserted in the slots of the shaft coupling for the arms on the force rod. The blocks are generally stowed nearby the output device, but for use they have to be located, removed from stowage and properly placed where they are supposed to go. There are ample opportunities for things to go wrong, such as misplacement or loss of the blocks, difficulty in locating the blocks even when they are where they should be, and erroneous installation. The use of blocks also presupposes the existence of adequate means other than the servo itself, which may be inoperable, to move the propeller blades to the emergency lock-up pitch setting. One such means are jacks positioned between suitable reaction abutments and the servo output ring—the jacks are also subject to loss, misplacement and improper use and constitute still another piece-part in the ship's equipment.

SUMMARY OF THE INVENTION

There is provided, in accordance with the present invention, an inboard servo for a force rod-type marine controllable pitch propeller that incorporates an improved servo feedback arrangement and an improved emergency lock-up arrangement. In particular the servo output arrangement includes a feedback ring located externally of and proximate to the servo cylinder and at least two connecting rods located generally symmetrically with respect to the axis of the force rod coupling the feedback ring to the piston for conjoint movement therewith, the connecting rods passing through openings in an end wall of the cylinder in sealed relation. The improved emergency lock-up arrangement includes at least two threaded locking rods affixed to the cylinder and received freely through holes in the feedback ring in generally symmetrical relationship with respect to the axis of the force rod and a locking nut received by each locking rod between the feedback ring and the cylinder and adapted to be threaded along the respective rod into engagement with the feedback ring. Upon such engagement movement of the feedback ring is prevented, and consequently the piston cannot move in a direction away from the feedback ring because of the fixed connection between the feedback ring and the piston afforded by the connecting rods.

The invention has many advantages. For one thing the feedback device and lock-up device are both associated solely with the servo cylinder and do not involve the propeller shaft or force rod per se. This means that the shaft may be provided with a standard coupling. In any case the special slotted shaft fitting, which is large, heavy and costly, is eliminated. For another, the nuts can be used to position propeller pitch or move the propeller blades to the emergency lock-up setting, although in many cases a powered back-up or manual hydraulic pump can be used. A further advantage is that the lock-up is permanently installed in the pitch-control apparatus —the lock-up nuts are captured on the rods - and is always ready for use. The invention is of simple and reliable construction and can be made, installed and maintained at comparatively low cost. It is, moreover, easy to use and is inherently adapted to be properly used.

For a better understanding of the present invention reference may be made to an exemplary embodiment, taken in conjunction with the accompanying drawing.

DESCRIPTION OF THE DRAWING

The single FIGURE of the drawing is a side cross-sectional view taken along an axial plane that is broken at the axis, one-half of the view being along a plane orthogonal to the other half.

DESCRIPTION OF THE EMBODIMENT

The embodiment comprises a cylinder 10 built up from a fore end wall member 12, an aft end wall member 14 and a circular-cylindrical peripheral wall member 16. It is designed to be coupled to the output shaft (not shown) of the ship's gear box (not shown) by a coupling (not shown) bolted to the fore end wall member 12. Concentric pipes 18 and 20 lead forward from an opening 22 in the wall 12 to a rotary union or oil distribution ("O.D.") box (not shown) for supplying hydraulic fluid to the cylinder, the inner pipe 20 opening to and supplying the fore part of the cylinder and the annulus between the pipes 18 and 20 supplying the aft part of the cylinder through a passage composed of branches 24, 26 and 28 drilled, plugged and sealed, as shown, in the cylinder members 12 and 16. The rotary joint or O.D. box may be located between the servo cylinder 16 and the gear box, within the gear box or forward of the gear box on an extension of the gear box output shaft, as is well known per se.

The aft wall member 14 has an integrally-formed propeller shaft segment 30 having a coupling (not shown) at the aft end for joinder to a mating coupling on the propeller shaft (not shown). A force rod 32 extends aftward through the shaft segment and the shaft and is coupled to the pitch control mechanism (not shown) of the propeller. A preferred pitch control mechanism is described and shown in U.S. patent application Ser. No. 080,791 filed Aug. 3, 1987, and entitled "Controllable Pitch Marine Propeller," but the present invention can be used with virtually any force rod-type controllable pitch propeller. The forward end of the force rod 32 is affixed to a piston 34 by a nut 36 locked in place by a locking dog 38. When hydraulic fluid is supplied from the pipe 20 to the fore part of the cylinder chamber to drive the piston aft (to the left in the drawing), the propeller is moved toward maximum ahead pitch; conversely, supply of fluid to the aft part of the cylinder chamber through the annulus between the pipes 18 and 20 and the passage branches 24, 26 and 28 drives the piston forward and moves the propeller blades toward maximum astern pitch. A suitable control system, the designs for which are well-known to those skilled in the art, enables the propeller pitch to be set to any desired value between maximum ahead and maximum astern.

An element of most controllable pitch propeller control systems is a feedback device for providing an indication of the actual pitch setting of the propeller. In the present invention, the feedback device comprises a pair of connecting rods 40 (only one shown in the broken cross-section) located diametrically opposite each other, with respect to the axis of the force rod 32. As described below, the rods 40 not only provide a feedback function but are subjected to high loads in the emergency lock-up function; therefore, at least two, and possible more, rods 40, preferably arranged symmetrically for balancing loads, are highly desirable. Each feedback rod 40 is secured at a threaded connection 42 to the piston, passes through a seal ring 44 and is joined to a feedback ring 46 by a nut 47 and lock washer 49. The feedback ring 46 rotates within a bearing 48 relative to a non-rotating feedback output ring 50 that is restrained against rotation and guided axially by a guide rail 52. An attachment fitting 54 on the output ring 50 receives a link, such as a cable, that couples the feedback device to the control system. As the piston 34 and force rod 32 move axially, the feedback rings 46 and 50 follow the movements and provide feedback to the control system.

The emergency lock-up device consists of two (or more) threaded rods 56 fastened to the servo cylinder 10. In the embodiment each rod 56 is attached to the aft end wall member 14 by installing it in a hole 58 where it is retained by a head 60, a nut 62 and a lock washer 64. Each rod passes freely through a hole 66 in the feedback ring 46. To lock up the servo, with the propeller in ahead pitch a nut 68 and locknut 69, which normally reside idly threaded down against the nut 62, are threaded aftwardly along the rod to bear against the forward face of the feedback ring 46. To lock the servo with the propeller in astern pitch, a nut 71, and locknut 72, which normally are locked together to prevent rotation at the aft end of the threaded rods 56, are threaded forward along the rod to bear against the aft face of the feedback ring 46.

It will be recalled that the force rod 32 is loaded in compression when it is moved aftward and the propeller blades are set to ahead pitches and is loaded in tension when it is pulled forward to set the blades in astern pitches. Therefore, the thrusts of the working blades produce reaction forces, tending to push the force rod forward for ahead blade pitches and aftward for astern blade pitches. The feedback ring 46 cannot, however, move forward when the nuts 68 and 69 are threaded aftward along the rods 56 to bear against it or move aft when nuts 71 and 72 are threaded forward to bear against it. The feedback rods 40, in turn, hold the piston 34 and force rod 32 in a position established by the locations of the nuts 68, 69, 71 and 72, which may be indicated by markings on the rail 52 or in any suitable manner. Conventionally, the emergency lock-up settings of the propeller are partially ahead pitch or partially astern pitch to minimize the possibility of overloading the engine and drive The lock-up or take-home blade pitch will ordinarily be used only in case of some failure of the pitch control system.

The emergency lock-up is, of course, activated with the propeller and shaft stationary and with a protective cover 70 over the feedback and lock-up devices removed. A standby powered emergency pump or a hand pump can be used to establish the lock-up blade pitch, but the lock-up pitch can also be established by manually turning out the nuts 68, 69, 71 and 72 with wrenches.

I claim:

1. In an inboard servo for controlling the pitch of a marine controllable pitch propeller of the type in which the pitch is controlled by a force rod received in and movable axially of a propeller drive shaft, the servo having a hydraulic cylinder adapted to be affixed to the shaft coaxially with and for rotation with the shaft, a piston in the cylinder coupled to the force rod, means for supplying hydraulic fluid under pressure selectively to the cylinder on either side of the piston to move the piston and force rod forward or aftward for propeller pitch control, a feedback device for detecting the position of the force rod as an indication of the actual pitch of the propeller, and an emergency lock device for preventing movement of the force rod relative to the shaft the improvement wherein the feedback device includes a feedback ring located externally of and proximate to an end wall of the cylinder and concentric with the cylinder axis and at least two connecting rods located symmetrically with respect to the axis of the force rod and coupling the feedback ring to the piston for conjoint movement therewith, the connecting rods passing through openings in said end wall of the cylinder in sealed relation, and, wherein the emergency lock device includes at least two threaded looking rods affixed to the cylinder and received freely through holes in the feedback ring in symmetrical relation with respect to the axis of the force rod such that the feedback ring can move freely relative to the threaded rods, over the entire working stroke of the piston, and at least one locking nut received by each locking rod, each locking nut normally being positioned on the respective threaded rod in a location where it is not engageable by the feedback ring at any point during the working stroke of the piston in controlling propeller pitch but being adapted to be threaded along the respective locking rod and into engagement with the feedback ring at a selected point along the working stroke of the piston to establish and hold a selected propeller pitch by preventing movement of the feedback ring relative to said end wall and consequently preventing the piston from moving relative to the feedback ring because of the fixed connection between the feedback ring and the piston afforded by the connecting rods.

2. An inboard servo according to claim 1 and further characterized in that a locking nut is received on each locking rod between the feedback ring and said end wall of the cylinder.

3. An inboard servo according to the claim 1 and further characterized in that a locking nut is received on each locking rod between the end thereof and the feedback ring.

4. An inboard servo according to claim 1 and further characterized in that a first locking nut is received on each locking rod between the feedback ring and said end wall of the cylinder and a second locking nut is received on each locking rod between the end thereof and the feedback ring.

* * * * *